US007856913B2

(12) United States Patent
Matzunsky et al.

(10) Patent No.: US 7,856,913 B2
(45) Date of Patent: Dec. 28, 2010

(54) ROTARY CUTTING BLADE

(75) Inventors: Helmut Matzunsky, Oberammergau (DE); Rainer Schulze, Rieplos (DE)

(73) Assignee: Weber Maschinenbau GmbH Breidenbach, Breidenbach (DE)

( * ) Notice: Subject to any disclaimer, the term of this patent is extended or adjusted under 35 U.S.C. 154(b) by 729 days.

(21) Appl. No.: 11/129,585

(22) Filed: May 13, 2005

(65) Prior Publication Data

US 2005/0262980 A1 Dec. 1, 2005

(30) Foreign Application Priority Data

May 13, 2004 (DE) ..... 10 2004 023 670
Dec. 10, 2004 (DE) ..... 10 2004 059 479

(51) Int. Cl.
*B26D 5/20* (2006.01)

(52) U.S. Cl. ..... 83/676; 83/342; 83/666; 83/672; 83/341; 83/932

(58) Field of Classification Search ..... 83/596, 83/676, 932, 665, 666, 340, 672, 342, 341, 83/663; 30/310, 109, 357
See application file for complete search history.

(56) References Cited

U.S. PATENT DOCUMENTS

| | | | | | |
|---|---|---|---|---|---|
| 1,820,234 | A * | 8/1931 | Lees | 30/357 |
| 2,090,228 | A * | 8/1937 | Porter et al. | 30/252 |
| 3,299,925 | A | 1/1967 | McBrady et al. | 146/95 |
| 3,727,504 | A * | 4/1973 | Osterholt | 83/483 |
| 3,863,538 | A | 2/1975 | Behnke | |
| 3,921,485 | A * | 11/1975 | Tobey et al. | 83/342 |
| 4,625,782 | A * | 12/1986 | Jameson | 144/193.1 |
| 4,891,885 | A * | 1/1990 | Fischer et al. | 30/355 |
| 5,979,285 | A | 11/1999 | Rasmussen et al. | |
| 6,813,835 | B2 * | 11/2004 | Deville | 30/254 |
| 7,093,364 | B2 * | 8/2006 | Hsieh | 30/90.1 |
| 2010/0162868 | A1 * | 7/2010 | Weber | 83/676 |

FOREIGN PATENT DOCUMENTS

| | | |
|---|---|---|
| DE | 1 934 704 | 3/1966 |
| DE | 2 235 260 | 1/1974 |
| DE | 24 32 112 | 1/1976 |
| DE | 28 31 690 | 1/1980 |
| DE | G 88 13 952.2 | 2/1998 |
| DE | 196 46 656 | 5/1998 |
| DE | 196 46 656 C2 | 5/1998 |
| DE | 298 00 868 | 7/1999 |
| DE | 101 08 018 | 9/2002 |
| DE | 101 08 018 A1 | 9/2002 |
| EP | 0243981 A1 | 11/1987 |
| EP | 0 709 170 | 5/1996 |
| EP | 0709170 A1 | 5/1996 |
| WO | WO 96/40475 | 12/1996 |

* cited by examiner

*Primary Examiner*—Boyer D Ashley
*Assistant Examiner*—Omar Flores-Sánchez
(74) *Attorney, Agent, or Firm*—Collard & Roe, P.C.

(57) ABSTRACT

A rotary cutting blade provided with a curved cutting edge and a cutting surface extending centripetally from the cutting edge at angles varying in regular or irregular sequence between a predetermined maximum and a predetermined minimum.

8 Claims, 2 Drawing Sheets

A - A

B - B

C - C

α1
α2
α3
α1 - α2
α2 - α3
A
B
C
1
2
3
4
5
6
7
7'
7''
8
9
10
11

ROTARY CUTTING BLADE

BACKGROUND OF THE INVENTION

1. Field of the Invention.

The invention, in general, relates to a novel rotary cutting blade and, more particularly, to a rotary cutting blade provided with a cutting edge of varying thickness.

2. The Prior Art.

Rotary cutting blades of disk-like configuration are known, for instance, from European patent specification EP 0,709,170 A1 and are used for cutting or slicing food products such as, for instance, cheese, sausage, ham and the like. Such blades operate at high cutting frequencies in excess of 1,000 slices per minute. In industrial production processes, the slices are assembled and packaged in stacks. At the retail level, the slices are then usually spread out in imaginative or fanned-out patterns to be presented for sale in a set-up appealing to purchasers.

In addition to rotationally symmetric circular blades, blades with a sickle-shaped or spiral outer contour have found increasing acceptance. Such blades are provided with a cut-out which forms an angular void or gap in their circumference and which serves incrementally to advance the material being cut, slice by slice, once every revolution of the blade. Such rotational blades, sometimes referred to as slicer blades, yield substantially higher cutting rates in view of the fact that unlike circular blades they require no reciprocal movements normal to their axis of rotation, out of and into their operating position following each cut in order to advance the material into the cutting plane.

Compared to circular rotary cutting blades, the cutting rate of food products is significantly increased by rotary blades provided with a peripheral angular cut-out. Depending upon the kind of material to be sliced and its consistency, the number of rotations of, and, hence, cuts by, such "notched" blades may be as high as 1,500 per minute. The continuous feeding of the material to be cut in a direction parallel to the axis of rotation of the blade leads to higher pressure and, therefore, friction between the blade and the material. This may lead to frictional losses and detrimentally affect the surface of the slices cut. Because of the heat generated by the friction, the visual appearance and taste of the cut slices may suffer as well.

Stepped angular formations in the rotary blade surface, and, more particularly, ground-out voids in their surface facing the material to be cut, are intended substantially to avoid those disadvantages in accordance with the above-mentioned European patent specification EP 0,709,170 A1 and German patent specification DE 196 46 656 C2. For this purpose and for reducing the area of contact between the blade and the material to be cut as well as to reduce vibrations in the blade, the rotary cutting blades are provided in their surface facing the material to be cut with a relatively small annular zone and, also in the surface facing the material, a recessed area radially disposed further inward.

A rotary blade of a similar kind is disclosed by German patent specification DE 101 08 018 A1 in which the cutting edge is shaped as undulations with regularly spaced recesses and elevations to provide for an interrupted cutting sequence when used as intended. Cutting machines equipped with such blades are intended to be more economical. The disadvantage inherent in prior art blades is that, when used, material to be cut will often be trapped in the cutting edge recesses which detrimentally affects the quality and appearance of the cuts and, more particularly, of the cut slices.

OBJECT OF THE INVENTION

It is an object of the invention to provide a rotary cutting blade for cutting food products capable of producing and placing slices of satisfying quality at an improved economic efficiency while avoiding the disadvantages of prior art apparatus.

SUMMARY OF THE INVENTION.

In accordance with the invention, the object is accomplished by a rotary cutting blade of the kind referred to with a curved cutting edge of constant or variable radius and provided with a cutting surface formed such that commencing at the cutting edge and terminating in a centripetally extending inclined or beveled surface area it varies in size and alternating sequence imparting to the circumferential cutting surface a meandering or undulating structure.

Blades with a curved cutting edge of variable radius will hereinafter sometimes be referred to a sickle blades; those of constant radius will from time to time be referred to as circular blades.

Rotary blades fabricated in accordance with the invention are characterized by the shape and structure of their cutting surfaces radially extending between an internal inclined or beveled and substantially annular blade surface and their cutting edge, wherein over its circumference the cutting surface varies in its cutting angle so that the cutting surface assumes a meandering or wavy configuration.

Both radial and circumferential angle of the cutting surface may vary in size as well as sequence to satisfy requirements of the materials to be cut or sliced.

By structuring the cutting edge and, more particularly, the cutting surface, with varying cutting angles and lengths, it has been found that the quality of every initial or impact cut as well as the ensuing cut is improved. This, in turn, has been found to result in superior quality stacks of sliced materials of different consistencies and varying degrees of hardness.

The fact that the cutting surface may be varied to suit particular materials to be cut is a particularly advantageous aspect of the invention. Whereas an obtuse cutting angle positively affects the depositing of a slice of cut material, it acts detrimentally upon the initial cutting action. The initial cutting action is advantageously performed by a cutting edge of acute angularity.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DETAILED DESCRIPTION OF THE PREFERRED EMBODIMENTS

Figures 1, 2, 3, 4:
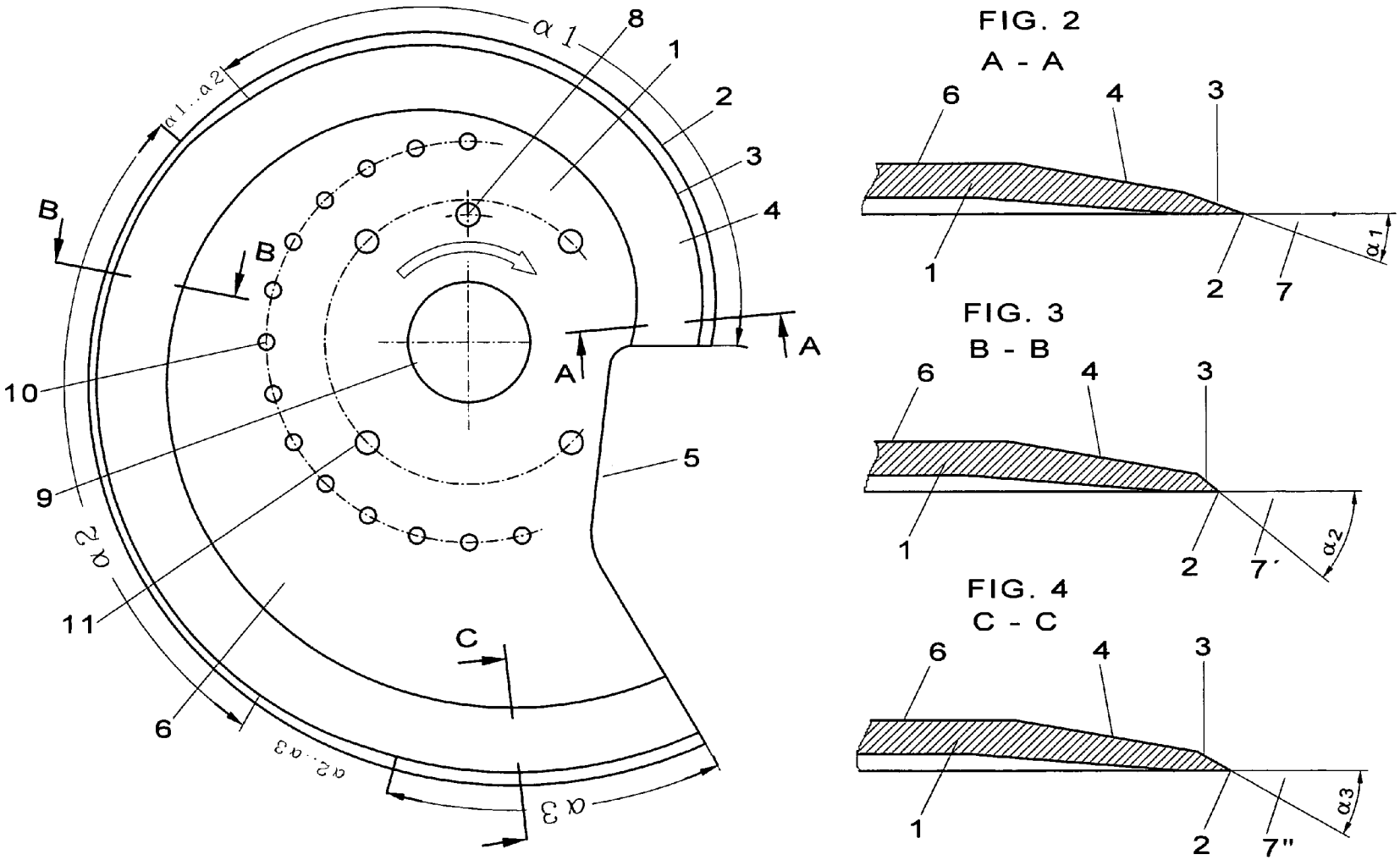
FIG. 1 depicts a rotary cutting blade of sickle-like structure with varying cutting edge angles in the area of its cutting surface.
FIG. 2 is a view along section line A-A of FIG. 1.
FIG. 3 is a view along section line B-B of FIG. 1.
FIG. 4 is a view along section line C-C of FIG. 1.

FIG. 1 shows a rotary cutting blade 1, sometimes referred to as a slicer blade, in accordance with the invention of a sickle-like structure and featuring a cut-out section 5. The sickle-like blade 1 consists of a substantially flat leaf provided at a portion of its periphery a cutting edge 2 of a radius which increases from a minimum to a maximum. The outer contour or periphery of the blade 1 is shown in FIG. 1. The cut-out section 5 is disposed between the peripheral minimum and maximum of the blase 1 and is not provided with any cutting edge. Commencing from the cutting edge 2, the sickle blade 1 is provided, on at least one of its surfaces, with a cutting surface 3 which runs along the blade 1 substantially parallel to the cutting edge 2 thereof and extends in the direction of the center or rotary axis of the blade 1.

The cutting surface 3, commencing at the cutting edge 2, is inclined at varying angles to form the cutting angles 7 of the sickle-blade 1. Following the cutting surface 3 in a centripetal direction of the blade 1, there is shown a further inclined surface area 4 which transitions into a substantially planar surface area 6 extending normal to the axis of rotation of the blade 1.

In the surface area 6, in the center of the blade 1, there is provided an opening 9 for aligning the blade 1 on a drive chuck or the like of a cutting machine (not shown). A plurality of bores 10 surrounding the bore 9 spaced uniformly from each other and from the axis of rotation of the blade 1, within surface area 6, serves to receive, if necessary, counter weights (not shown) to ensure a round rotation of the blade 1. A plurality of further bores 11 surrounding the bore 9 at equal distances therefrom and from each other serves to secure the blade 1 to the chuck of the cutting machine by threaded connectors, as is well known in the art.

For fixing a relationship between the cutting angle 7 of the blade 1 with respect to its rotation and, therefore, successive further cutting angles 7, a so-called coding point 8 is placed within the surface area 6 of the blade 1.

Shape and arrangement of the individual cutting angles 7 to 7" relative to the cutting surface 3 are shown in FIG. 2 to 4 depicting sectional views along section lines A-A, B-B and C-C of FIG. 1 of the cutting area of the blade 1.

The sectional views of FIGS. 2 to 4 are selected arbitrarily solely for purposes of explanation without limiting the scope of the invention. Any other cutting position of the cutting area or surface 3 would be equally representative of the structure of the cutting area and especially of the structure and arrangement of the cutting angle 7 to 7" of the blade 1.

FIG. 2 depicts the structure at cutting position A-A of the cutting surface 3 of the sickle-blade 1 showing a cutting angle 7, labeled $\alpha_1$, which extends from the cutting edge 2 across the cutting surface 3. Similar to FIG. 2, FIGS. 3 and 4, respectively depict cutting angles 7' or $\alpha_2$ and 7" or $\alpha_3$ at cutting positions B-B and C-C. The dimensions of the cutting angles 7, 7' and 7" lie between 15° to 40°. Preferably, angles $\alpha_1$ and $\alpha_3$ equal about 20° and angle $\alpha_2$ equals about 33°.

Figure 5:
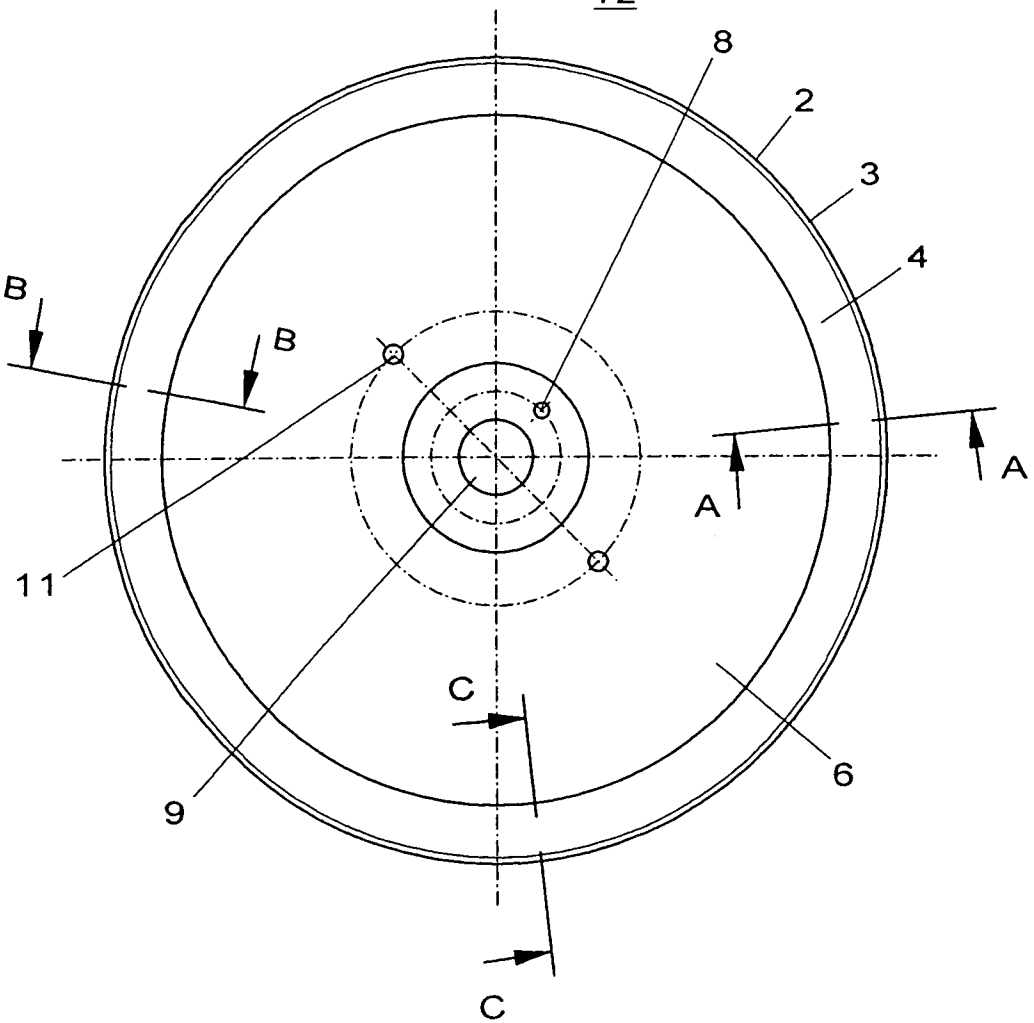
FIG. 5 depicts a rotary cutting blade of circular structure with cutting areas structured in accordance with the invention.

FIG. 5 shows, as an alternate embodiment of the invention, a rotary cutting blade 12 consisting of a substantially flat leaf of circular configuration having an axis of rotation substantially in the center thereof. On at least one of its surfaces the blade 12 is provided with a cutting surface 3 which extends centripetally inwardly from a cutting edge 2 which runs along the entire periphery of the blade 12. The cutting surface 3 transitions into an annular inclined surface area 4 which, in turn, changes to an annular planar surface area 6 disposed normal to the axis of the blade 12 and coaxially therewith.

For mounting on a chuck or the like of a cutting machine (neither shown), the blade 12 is provided with a central opening 9 and bores 11, the latter serving to receive threaded fasteners or the like. In the center surface area 6, there is also provided a coding point 8 for receiving coding elements and to provide an indication of the relationship between the position of the cutting angle 7 of the blade 12 and the rotary movement thereof as well as of the disposition of successive further cutting angles.

Figure 6:
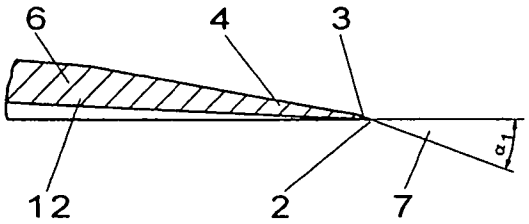
FIG. 6 is a view along section line A-A of FIG. 5.
Figure 7:
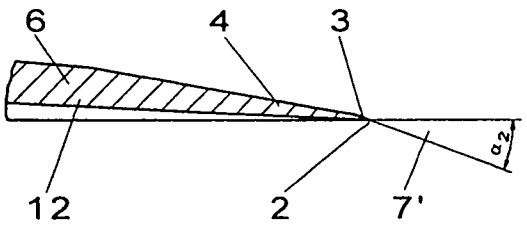
FIG. 7 is a view along section line B-B of FIG. 5.
Figure 8:
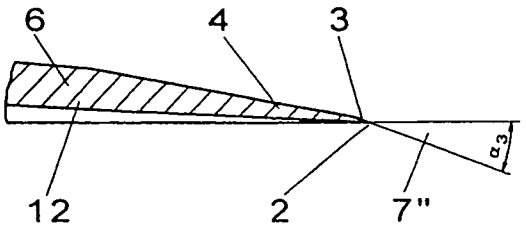
FIG. 8 is a view along section line C-C of FIG. 5.

As in the case of the embodiment of FIG. 1, the cutting area 3 varies in its inclinations to provide cutting angles between 7 to $7_n$. FIGS. 6-8 being, respectively, cross-sectional views of the blade 12 at section lines A-A, B-B and C-C, depict cutting angles 7, 7' and 7", or $\alpha_1$, $\alpha_2$ and $\alpha_3$, varying, by way of example, between about 15° and 40°. The preferred angularity is that mentioned in connection with the previous embodiment.

It will be understood by those skilled in the art, that in the rotary cutting blades 1 and 12 of either embodiment, position and sequence of the cutting angles 7 to 7" on the cutting surface 3 are to some extent arbitrary but depend in terms of shape, size and angular extent not least upon the material intended to be sliced. In particular, their sequence of placement may be regular or irregular.

What is claimed is:

1. A rotary cutting blade, comprising:

a leaf comprising two opposite surfaces forming between them a smooth cutting edge extending along at least a portion of their periphery;

a single smooth inclined cutting surface extending inwardly and inclined at varying angles from the cutting edge at one of the two opposite surfaces, the inclination varying from at least one minimum angle to at least one maximum angle, wherein a distance between said at least one minimum angle to a closest maximum angle, measured along the cutting edge, is larger than any radial distance from the cutting edge to a center of the blade;

a smooth inclined surface extending inwardly from the cutting surface, said smooth inclined surface being disposed on the same one of the two opposite surfaces as the cutting surface; and a substantially planar surface extending inwardly from the inclined surface and provided with means for mounting the blade for rotation about an axis disposed at a predetermined relationship to the cutting edge.

2. The rotary cutting blade of claim 1, wherein the angles of inclination within the cutting blade vary between 15° and 40°.

3. The rotary cutting blade of claim 2, wherein the minimum angle is about 20° and the maximum angle is about 33°.

4. The rotary cutting blade of claim 3, wherein the maximum and minimum angles are arranged in a regular sequence along the cutting edge.

5. The rotary cutting blade of claim 3, wherein the maximum and minimum angles are arranged in an irregular sequence along the cutting edge.

6. The rotary cutting blade of claim 1, wherein the periphery increases from a radial minimum to a radial maximum relative to the axis of rotation of the blade.

7. The rotary cutting blade of claim 6, wherein the radial maximum and radial minimum are interrupted by a cut-out section in the blade.

8. The rotary cutting blade of claim 1, wherein the periphery of the blade is disposed at a substantially uniform distance from the axis of rotation.

* * * * *